United States Patent [19]

Burke

[11] Patent Number: 4,586,258

[45] Date of Patent: May 6, 1986

[54] AXE

[76] Inventor: Edward R. Burke, P.O. Box 235, Lima, Pa. 19037

[21] Appl. No.: 607,799

[22] Filed: May 7, 1984

[51] Int. Cl.[4] ..... B26B 23/00

[52] U.S. Cl. ..... 30/308.1

[58] Field of Search ..... 145/2 R, 2 A, 3

[56] References Cited

U.S. PATENT DOCUMENTS

| | | | |
|---|---|---|---|
| 424,205 | 3/1890 | Hufford | 145/2 R |
| 1,404,660 | 1/1922 | Shugart | 145/2 R |
| 1,504,644 | 8/1924 | Rayburn | 145/2 R |
| 1,729,365 | 9/1929 | Sells | 145/2 R |
| 4,300,606 | 11/1981 | Branson | 145/2 R |

FOREIGN PATENT DOCUMENTS

| | | | |
|---|---|---|---|
| 43609 | 1/1931 | Denmark | 30/308.1 |
| 12741 | 7/1901 | Sweden | 145/2 R |
| 79336 | 1/1934 | Sweden | 145/2 R |

*Primary Examiner*—Frederick R. Schmidt
*Assistant Examiner*—J. T. Zatarga
*Attorney, Agent, or Firm*—Robert S. Lipton; Robert B. Famiglio; Barbara C. Siegell

[57] ABSTRACT

An axe head, for splitting wood is disclosed. The outside surface of the axe head has a convex shape, while the upper portion of the inside surface has a concave shape. In an alternative embodiment of the invention, the entire inside surface of the axe head, has a concave shape. The combination of the convex and concave outer and inside surfaces of the axe head enhance the axe's ability to split wood.

7 Claims, 5 Drawing Figures

AXE

BACKGROUND OF THE INVENTION

This invention relates to an approved axe in general, and an axe for splitting wood, in particular.

An object of most axes, other than chopping wood, is their use in splitting chunks of wood. Such splitting, is generally done along the grain of the piece of wood. The typical "wedge shape" of wood splitting axes is to facilitate such splitting, by forcing the portions of the piece of wood on opposing sides of the inserted axe apart.

U.S. Pat. No. 4,300,606 issued Nov. 17, 1981 to Branson teaches a wood splitting axe head which has a slight convex shape on its outside surface. Branson claims a unique mass distribution of the axe head which is to facilitate the splitting of wood.

The prior art is repleat with other designs and the like for enhancing the wood splitting capability of the basic wedge shaped axe. The prior art also discloses sophisticated axe head designs incorporating movable parts which force the opposing portions of the piece of wood apart as the axe head is sunk into the piece of wood.

SUMMARY OF THE INVENTION

The present invention is an improved wood splitting axe. The head of the axe has an outside surface having a convex shape. The upper portion of the inside surface has a concave shape. In an alternative embodiment of the invention, the entire inside surface of the axe head is concave.

As used herein, it will be understood that the terms "outside face" and "inside face" of the axe head shall refer to the right and left hand sides on side faces of the axe head, from the right handed users perspective. The present invention shown and described is designed for use by a right handed wood cutter. Although both right and left handed persons swing a splitting axe such as the present invention from over head, there are differences in the direction of swing between right and left handed persons. It will be obvious to one skilled in the art to modify the design for use by a left handed person.

Accordingly, it is the object of the present invention to provide an improved axe head for use in cutting wood.

It is another object of the present invention to provide an improved axe head for splitting wood which has no moving parts.

It is a further object of the present invention to provide an improved axe having a head with a convex outer surface and at least a partially concave inner surface.

BRIEF DESCRIPTION OF THE DRAWINGS

The construction of the preferred embodiment as well as further objects and advantages of the invention will become further apparent from the following specifications when considered with the accompanying drawings in which like numerals refer to like parts wherein.

DESCRIPTION OF THE PREFERRED EMBODIMENT

Figure 1:
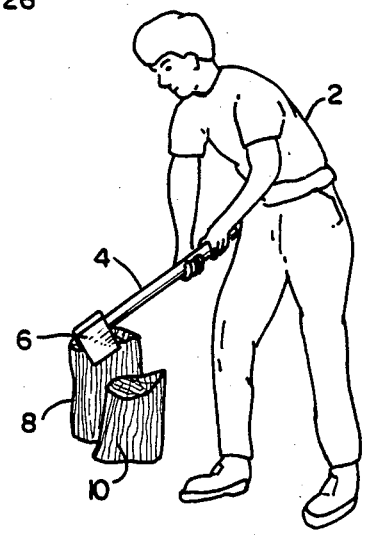
FIG. 1 shows a person using an axe of the present invention.

Reference will now be made to FIG. 1 wherein a person 2 is shown using an axe 4 of the present invention to split a piece of wood 6 into sections 8 and 10.

Figure 2:
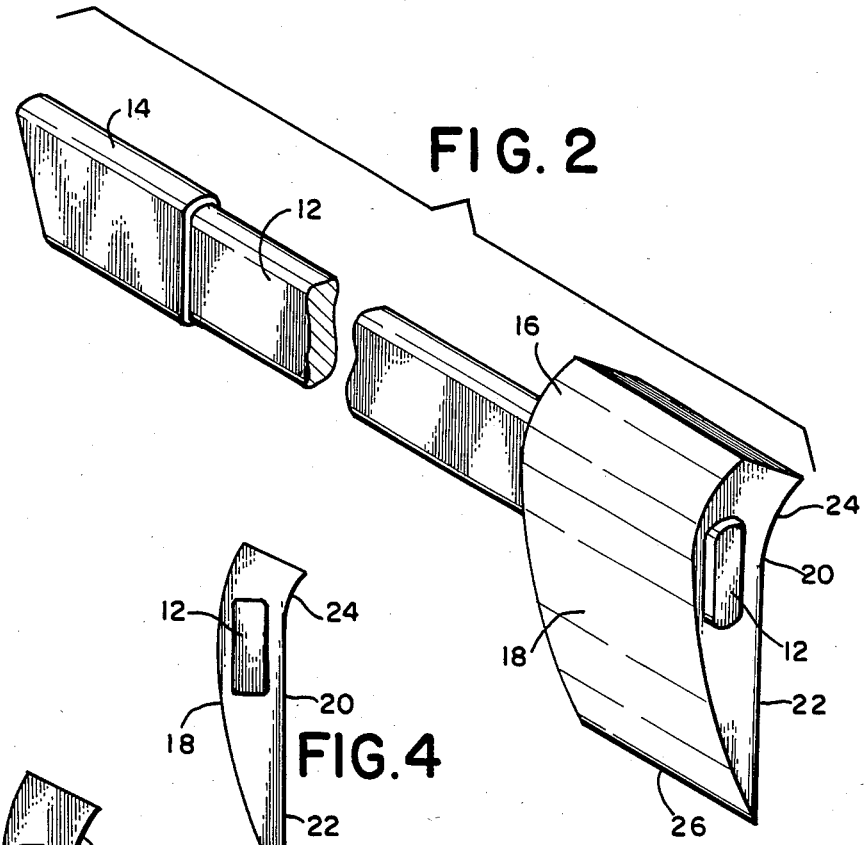
FIG. 2 is a pictorial view of an axe of the present invention.
Figure 3:
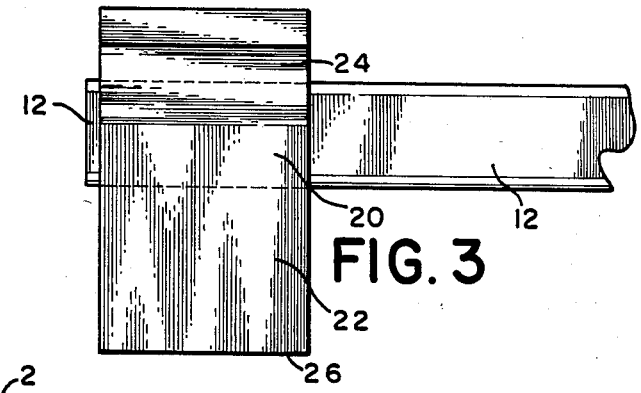
FIG. 3 is a side view of the axe head and handle of the present invention.

As is shown in FIGS. 2 and 3, the axe 4 includes a handle 12. The handle 12 has a grip 14 connected to one of its ends. At the other end of the handle 12 is an axe head 16. The head 16 is connected to the handle 12 through well known and conventional means.

Head 16 has an outer surface 18 and an inner surface 20. The inner surface 20 includes a straight portion 22 and a concave portion 24. The outer surface 18 is convex. The convex outer surface 18 and the inner surface 20 converge at an apex to form a cutting edge 26 that is parallel to the axe head opening for the handle 12.

Figure 4:
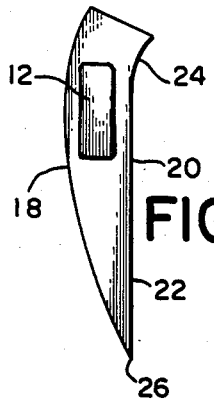
FIG. 4 is an end view of the axe shown in FIGS. 2 and 3.

As may be seen in FIG. 4, the inner straight surface 22 of the inner surface 20 extends approximately two-thirds ($\frac{2}{3}$) the height of the axe head. This is also the location of the axe handle 20, with respect to the head 16, i.e. the handle 12 is located a distance from the apex 26 of the head 16 equal to two-thirds ($\frac{2}{3}$) of the height of the head 16.

Figure 5:
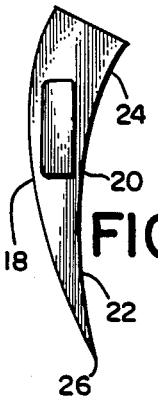
FIG. 5 is an end view an alternate embodiment of the invention.

In an alternate embodiment of the present invention shown in FIG. 5, the entire inside surface 20 of the invention is concave. In the alternate embodiment the axe handle is also located a distance from the apex 26 equal to approximately two-thirds ($\frac{2}{3}$) the height of the head 16. In both embodiments of the invention, both the outer convex surface and the inner concave surface have a radius of curvature which decreases as the distance from the apex 26 of the head 16 increases.

The present invention as shown in the accompanying drawings is used in a conventional manner, by swinging the axe over head by a right handed person. It has been found by experience, that an axe of the present invention provides superior wood splitting capabilities.

Although the present invention has been described with reference to the particular embodiment herein set forth, it is understood that the present disclosure has been made only by way of example and that numerous changes in the details of construction may be resorted to without departing from the spirit and scope of the invention. Thus, the scope of the invention should not be limited by the foregoing specifications, but rather only by the scope of the claims appended hereto.

What is claimed is:

1. A wood splitting axe mounted on an axe handle comprising: an elongated axe head having two side faces, an inner face, and an outer face, said inner and outer faces extending to opposite sides of the axe handle and converging to form a cutting edge, said head having a hole therein for receiving the axe handle and having its center line substantially parallel to said cutting edge, said outer face being entirely convex shaped, said inner face having at least a portion thereof including a concave portion, and at least part of said concave portion of said inner face extending beyond the handle location on the axe head and being located opposite said cutting edge.

2. The axe head of claim 1 wherein said inner face includes a straight portion, said straight portion converging with said outer face to form said cutting edge.

3. The axe head of claim 2 wherein said convex outer surface has a radius of curvature which decreases as the distance from said cutting edge increases.

4. The axe head of claim 3 wherein the radius of curvature of said inner concave surface decreases as the distance from said cutting edge increases.

5. The axe head of claim 4 wherein the axe handle is secured to the axe head at a distance from said cutting edge which is substantially equal to two-thirds ($\frac{2}{3}$) of the height of said axe head.

6. The axe head of claim 5 wherein the concave portion of the inner face begins at approximately $\frac{2}{3}$ of the way up the height of the axe head.

7. The axe head of claim 5 wherein the inner face is entirely concave.

* * * * *